US009537208B2

(12) United States Patent
Isom

(10) Patent No.: US 9,537,208 B2
(45) Date of Patent: Jan. 3, 2017

(54) DUAL POLARIZATION CURRENT LOOP RADIATOR WITH INTEGRATED BALUN

(71) Applicant: Raytheon Company, Waltham, MA (US)

(72) Inventor: Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 700 days.

(21) Appl. No.: 13/674,547

(22) Filed: Nov. 12, 2012

(65) Prior Publication Data

US 2014/0132473 A1 May 15, 2014

(51) Int. Cl.

| | |
|---|---|
| ***H01Q 5/00*** | (2015.01) |
| ***H01Q 21/08*** | (2006.01) |
| ***H01Q 1/50*** | (2006.01) |
| ***H01Q 21/00*** | (2006.01) |
| ***H01Q 1/38*** | (2006.01) |
| ***H01Q 1/40*** | (2006.01) |

(Continued)

(52) U.S. Cl.

CPC ..... *H01Q 1/50* (2013.01); *H01Q 1/38* (2013.01); *H01Q 1/40* (2013.01); *H01Q 1/422* (2013.01); *H01Q 5/364* (2015.01); *H01Q 7/00* (2013.01); *H01Q 9/0421* (2013.01); *H01Q 9/0435* (2013.01); *H01Q 21/0006* (2013.01); *H01Q 21/0087* (2013.01); *H01Q 21/24* (2013.01); *H01Q 23/00* (2013.01)

(58) Field of Classification Search

CPC .... H01Q 21/065; H01Q 9/0435; H01Q 1/405; H01Q 9/0457; H01Q 21/24; H01Q 9/0428

USPC ..... 343/700 MS, 830

See application file for complete search history.

(56) References Cited

U.S. PATENT DOCUMENTS 5,995,047 A * 11/1999 Freyssinier et al. ... 343/700 MS
6,320,542 B1 11/2001 Yamamoto et al.

(Continued)

FOREIGN PATENT DOCUMENTS

| | | |
|---|---|---|
| JP | U-1992207609 | 3/1992 |
| JP | 2000-312112 | 11/2000 |
| JP | 2006504375 A | 2/2006 |

OTHER PUBLICATIONS

Wong, et al.; "Broad-Band Single-Patch Circularly Polarized Microstrip Antenna with Dual Capacitively Coupled Feeds;", IEEE Transactions on Antennas and Propagation, vol. 49; No. 1; Jan. 2001; pp. 41-44.

(Continued)

*Primary Examiner* — Dameon E Levi
*Assistant Examiner* — Ricardo Magallanes
(74) *Attorney, Agent, or Firm* — Daly, Crowley, Mofford & Durkee, LLP

(57) ABSTRACT

A dual polarization current loop radiator realized with a via, probe, or exposed coaxial feed using part of a vertical metal structure of the radiator to guide current to a feed point of a horizontal metal plate capacitively coupled to the vertical metal structure is described. The vertical metal structure may be either stamped and attached to the ground plane or it can be formed along with metal backplane structure of the radiator. The top of the vertical metal piece is separated from the horizontal metal plate by a predetermined distance dielectric spacing. The spacing may be realized either a thin dielectric core or a non-conductive adhesive material.

22 Claims, 11 Drawing Sheets

(51) Int. Cl.

| | |
|---|---|
| ***H01Q 1/42*** | (2006.01) |
| ***H01Q 7/00*** | (2006.01) |
| ***H01Q 9/04*** | (2006.01) |
| ***H01Q 21/24*** | (2006.01) |
| ***H01Q 23/00*** | (2006.01) |
| ***H01Q 5/364*** | (2015.01) |

(56) References Cited

U.S. PATENT DOCUMENTS

| | | | | |
|---|---|---|---|---|
| 6,429,816 | B1 * | 8/2002 | Whybrew et al. | 343/700 MS |
| 7,688,265 | B2 | 3/2010 | Irion, II et al. | |
| 7,948,441 | B2 | 5/2011 | Irion, II et al. | |
| 2008/0036665 | A1 * | 2/2008 | Schadler | H01Q 1/42 343/700 MS |
| 2008/0169992 | A1 * | 7/2008 | Ortiz | H01Q 9/0428 343/767 |
| 2009/0073075 | A1 * | 3/2009 | Irion, II | H01Q 9/0414 343/859 |

OTHER PUBLICATIONS

Wong, et al.; "Design of Dual-Polarized L-Probe Patch Antenna Arrays With High Isolation," IEEE Transactions on Antennas and Propagation; vol. 52; No. 1; Jan. 2004; pp. 45-52.

PCT Search Report of the ISA for PCT/US2013/038408 dated Jun. 28, 2013.

Written Opinion of the ISA for PCT/US2013/038408 dated Jun. 28, 2013.

Notice of Preliminary Rejection with English Translation dated Feb. 27, 2016 for Korean Appl. No. 10-2015-7010618; 4 pages.

Response to Communication Pursuant to Rules 161(1) and 162EPC as filed Jan. 19, 2016 for EP Application No. 13721516.6; 35 pages.

PCT Transmittal of International Preliminary Report on Patentability for PCT/US2013/038408 dated May 21, 2015.

Japanese Office Action with Engiish Transiation dated Jun. 21, 2016 for Japanese Application Number 2015-541757; 8 pages.

* cited by examiner

DUAL POLARIZATION CURRENT LOOP RADIATOR WITH INTEGRATED BALUN

FIELD

The concepts, systems, circuits, devices and techniques described herein relate generally to radio frequency (RF) circuits and more particularly to RF antennas.

BACKGROUND

As is known in the art, in array antennas, performance is often limited by the size and bandwidth limitations of the antenna elements which make up the array. Improving the bandwidth while maintaining a low profile enables array system performance to meet bandwidth and scan requirements of next generation of communication applications, such as software defined or cognitive radio. These applications also frequently require antenna elements that can support either dual linear or circular polarizations.

As is also known, attempts have been made to fabricate low profile antenna elements and array antennas. Such array antennas include an array of tightly coupled dipole elements which approximates the performance of an ideal current sheet, as well as so-called "bunny ear" antennas, and tightly coupled patch arrays. While these antenna element designs are all low profile, they either fail to operate over a desired bandwidth or present significantly increased complexities to provide feed structures necessary to support either dual linear or circular polarizations (e.g. requiring external components difficult to fit within the unit cell of an array antenna). Other antenna elements, such as Vivaldi notch antenna elements, can provide a relatively wide bandwidth, but are not low profile.

It would, therefore, be desirable to provide an antenna element and an array antenna having a relatively low profile and which is responsive to either dual linear or circular polarization over a wide frequency bandwidth and scan volume.

SUMMARY

Described herein is an antenna element having an integrated balun/feed assembly. The antenna element may also be provided having an integrated balun/feed and radome (the combination of which is referred to herein as a radiating element). Such an antenna element and/or radiating element is suitable for use in wideband (WB) or ultra wideband (UWB) phased array antenna applications. Such an antenna element and array of such antenna elements may be suitable for use in applications and designs requiring fractional bandwidths of greater than 3:1 and that would benefit from not having an explicit (separate) balun in the feed structure. The antenna element with integrated balun/feed and radome is suitable for use in applications requiring a low antenna profile (i.e. a combined antenna element and radome assembly having a reduced height).

Such an antenna element and antenna array is suitable for use in applications where performance improvements, including volumetric improvements and installation height reductions, may be desired.

In accordance with the concepts, systems and circuits described herein, a dual polarization current loop radiator includes a metal patch radiator in a phased array Dielectrically spaced from a shaped metal tower which is conductively attached to a Metal backplane. The backplane provides a groundplane for the radiating element. A pair of feed circuits, each comprised of a vertical conductor and a feed line, are coupled to the patch radiator. The dual polarization current loop radiator is responsive to RF signals within a frequency band of interest through two different coupling mechanisms as follows. RF signals coupled or otherwise provided to the feed circuits are coupled in the desired radiating mode. The feed circuits (i.e. the feed lines and vertical conductors) guide current to feed points by guiding them along the sidewalls of the shaped metal tower. At lower frequencies within the band of interest, RF signals are coupled (i.e. either received by or emitted by) from the feed points to the patch element. At higher frequencies within a band of interest, RF signals are coupled from the feed points into the desired radiating mode via a guided path slotline mode formed within the current loop radiator structure between the feed circuit and the vertical wall of the shaped metal tower. Thus, the radiator supports two radiation mechanisms: a first radiation mechanism due to the patch element and a second radiation mechanism due to the guided path. The two radiation mechanisms are seamless (i.e. there is a seamless transition between these two different types of radiation) which leads to a significant increase in operational bandwidth and scan of the radiator.

With this particular arrangement, a compact patch radiator suitable for use in a phased array antenna is provided.

A plurality of antenna elements provided in accordance with the concepts and structures described herein results in an array antenna operable over a wide bandwidth and scan volume while maintaining a relatively low profile. In one embodiment, an array antenna provided in accordance with the concepts and structures described herein provides broadside performance over a frequency range of about 2.4 GHz to about 17.6 GHz at a height (or profile, including all radome and balun spacings and components) of about one inch above the metal backplane.

The height (or profile) for such a complete radiator/radome/balun combination is relatively low compared with the profile of prior art antenna elements and array antennas having similar operating characteristics.

In accordance with the concepts described herein, for applications requiring less bandwidth, the antenna height may be reduced to less than one inch. For example, n an antenna having a bandwidth from 2.4-17.6 GHz (i.e. a fractional 7.33:1 bandwidth) if it is desired to operate, for example in the frequency range of about 6 GHz to about 17.6 GHz, the antenna could be provided having a height approximately or about 0.4". If, however, it was desired to only operate in the range of about 12 GHz to about 18 GHz, the antenna could be provided having a height of about 0.2". These examples assume the scan performance required remains the same. If the scan angles required are reduced, the height can be reduced further. Furthermore, the scan performance degrades gracefully providing performance out to 70 degrees in both E- and H-planes. The antenna element described herein also provides good isolation and cross-polarization performance over scan.

It should be appreciated that this Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing and other objects, features and advantages of the Invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Described herein are structures and techniques for exciting and propagating electromagnetic waves in wave guiding structures. As used herein, the term "vertical plane" refers to a plane which extends along a length of the wave guiding structure and the term "horizontal plane " refers to a plane which is perpendicular to the vertical plane.

Figure 1:
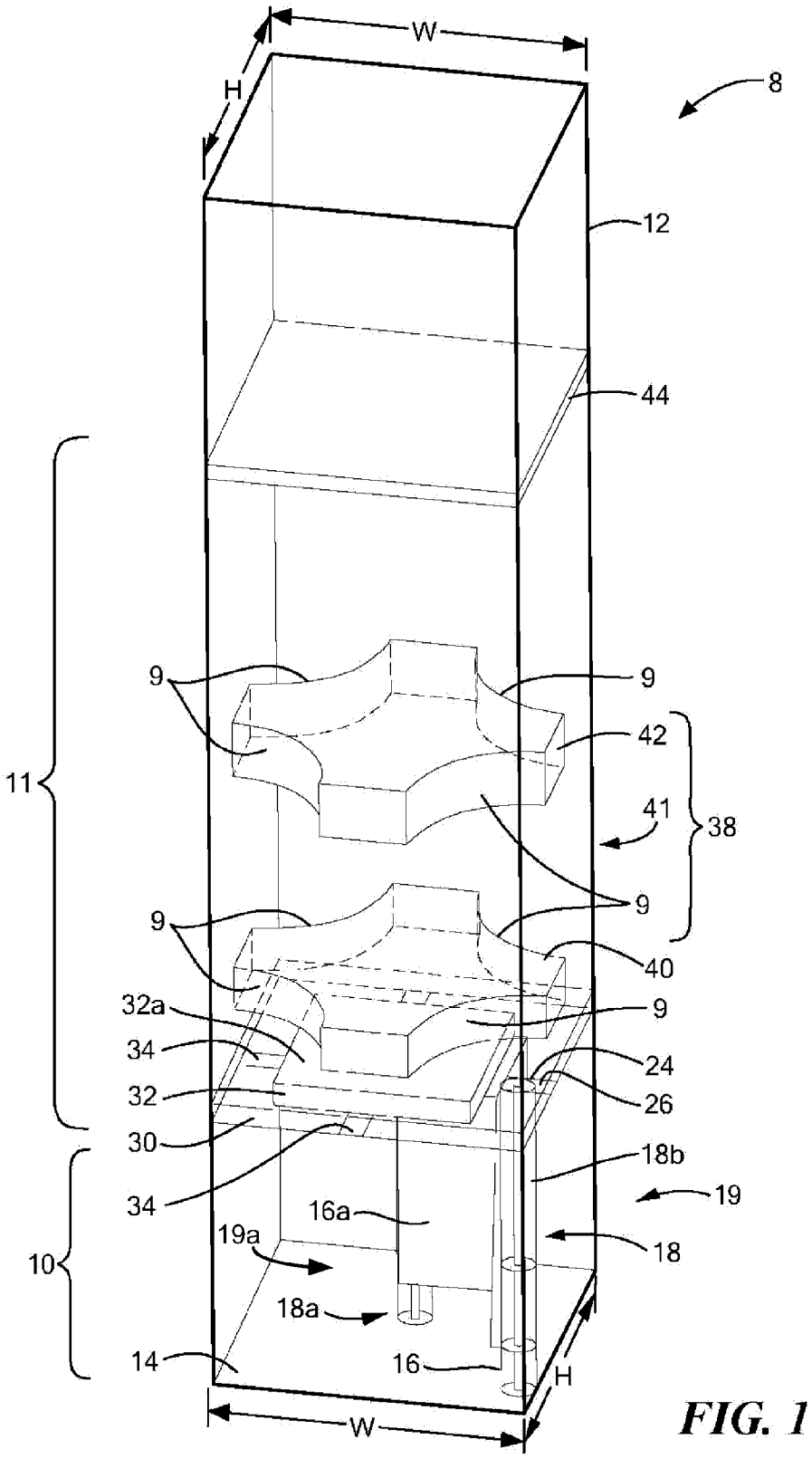
FIG. 1 is an isometric view of a unit cell of a dual polarization current loop Radiator having an integrated balun.
Figure 1A:
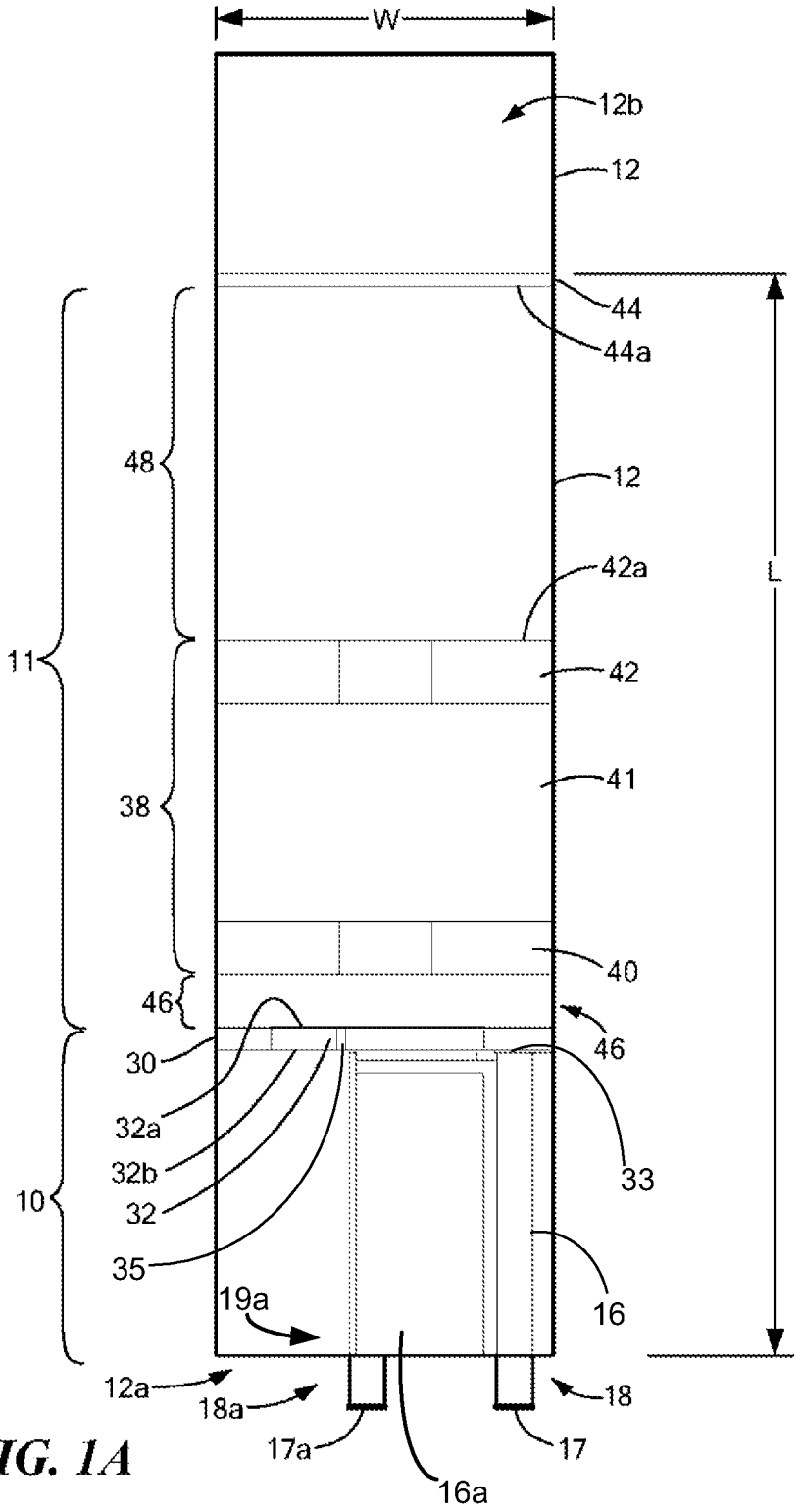
FIG. 1A is a side view of a unit cell of the dual polarization current loop radiator of FIG. 1.
Figure 2:
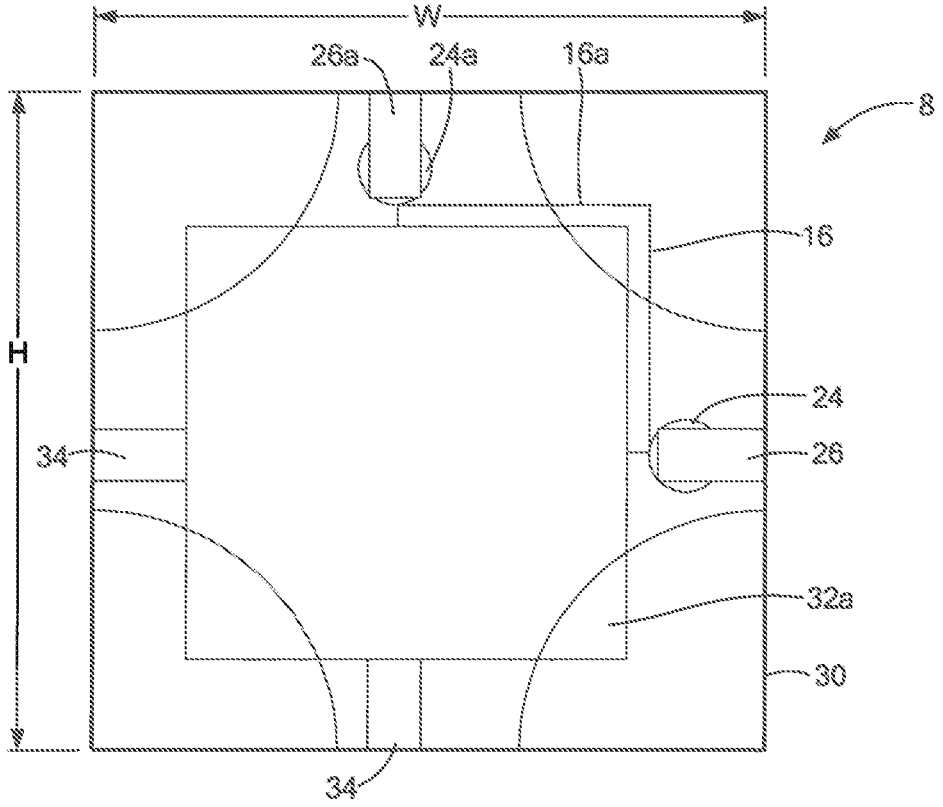
FIG. 2 is a top view of a unit cell of the dual polarization current loop radiator of FIG. 1.

Referring now to FIGS. 1, 1A and 2 in which like elements are provided having like reference designations throughout the several views, a dual polarization current loop radiator 8 includes an antenna element portion including an integrated balun and a radome portion 11. The balun is formed using an 'inside' conductive surface of a shaped conductive tower. The shaped conductive tower is provided from a pair of vertical conductors 16, 16*a* attached or otherwise electrically coupled to the backplane. An outside surface of the shaped conductive tower supports the guiding of the radiated wave. The balun structure is essentially a high impedance (compared to the feed line) cavity that directs the energy up the feed structure and guides it into the desired radiated mode. The unit cell 12 has a width W, a height H and a length L. The length of the shaped metal piece is generally chosen to be approximately quarter wavelength of the center frequency in the material (air in this case). The exact value may be adjusted somewhat from a starting value of a quarter wavelength as part of the iteration of the design.

In the exemplary embodiment of FIGS. 1-2, and for reasons which will become apparent from the description hereinbelow, unit cell 12 is here provided having a square cross-sectional shape (i.e. W=H as show in FIG. 2). Unit cell 12 may be air-filled (i.e. hollow) or filled (either partially or wholly filled) with a dielectric material. For broadest bandwidth and scan performance, air-filled is preferred.

Unit cell 12 has disposed across one end 12*a* thereof a backplane 14 which serves as a ground plane while a second end 12*b* of unit cell 12 is open.

A first conductor 16 having a width W1, a height H1 and a length L1 is disposed in a first vertical plane within unit cell 12. Since conductor 18 is disposed in a vertical plane, first conductor 16 is sometimes referred to as first vertical conductor 16 (or more simply "vertical conductor 18" or "vertical wall 18"). Vertical conductor 16 is electrically coupled to backplane 14. In one embodiment, this is accomplished by placing at least a portion of (e.g. one end of) vertical conductor 18 in physical contact with at least a portion of backplane 14 (e.g. using a ribbon conductor to provide an electrical connection between backplane 14 with vertical conductor 18.

The placement of the vertical walls 16, 16*a* are controlled by two factors. The first factor is the desire to maximize the bandwidth performances of the balun, particularly at the low frequencies. This is normally done by maximizing the volume between the inside walls of the shaped metal toward and the feed circuit. For this reason, it is desirable for the walls of the shaped metal tower to be thin. The second factor is controlling the impedance of the guided transmission structure formed by the feed circuit and the vertical walls of the shaped metal tower. To maintain a suitable impedance, it is generally desirable for the feed circuit and the vertical wall to be proximate to each other. This proximity also aids in improving isolation and cross-polarization performance.

It should be appreciated that vertical conductor 18 may be provided using a variety of different techniques. For example, vertical conductor 16 may be stamped and attached (e.g. bonded) to backplane 14 (e.g. via an automated pick and place operation). Alternatively, vertical conductor 16 may be formed or otherwise provided as part of backplane 14. Other techniques for providing vertical conductor 16 may, of course, also be used.

A first feed signal path 18(or more simply "feed line 18") is electrically coupled to vertical conductor 16. The combination of feed line 18 and vertical conductor 16 forms a feed circuit 19. In the exemplary embodiment of FIG. 1, feed line 18 is provided as a coaxial line disposed through the ground plane and thus feed circuit 19 corresponds to a coaxial feed circuit 19.

It should be appreciated that although in the exemplary embodiment of FIGS. 1-2 a coaxial feed circuit 19 is shown, those of ordinary skill it the art will recognize that feed line 18 may be implemented as one of a variety of different types of transmission lines including but not limited to any type of strip transmission line (e.g. a flex line, a microstrip line, a stripline, or the like). In still other embodiments, the feed may be provided as conductive via hole (or more simply "a via"), a probe, or an exposed center conductor of a coaxial line (as shown in the exemplary embodiment of FIG. 1). In still other embodiments, the feed may be provided as a coplanar waveguide feed line (either with or without a ground) or from as a slotline feed line. Those of ordinary skill in the art will understand how to select the particular manner in which to implement (fabricate) feed circuit 19 for a particular application. Some factors to consider in selecting the type of feed line to use for a particular application include but are not limited to frequency of operation, fabrication simplicity, cost, reliability, operating environment (e.g. operating and storage temperature ranges, vibration profiles, etc.).

In the exemplary embodiment illustrated in FIGS. 1-2, coaxial feed line 18 is electrically coupled to backplane 14 and at least a portion of coaxial feed line 18 passes through an opening in backplane 14. In particular, portions of outer conductor of coaxial feed line 18 are removed to expose a center conductor and surrounding dielectric (e.g. Teflon®) jacket. The center conductor and dielectric jacket extend into the unit cell. The dielectric jacket prevents the center conductor of coaxial line 18 from contacting vertical structure 16 which is coupled to ground. Coaxial feed line 18 and vertical metal structure 16 guide current to a feed point 24 which is coupled to into a radiated mode in the unit cell 12. In the exemplary embodiment described herein, the outer conductor of the coaxial line stops at a surface of the backplane. In other embodiments, however, it may be desirable or even necessary to extend the outer conductor of the coaxial line past the backplane and into the unit cell.

A horizontal substrate 30 having a metal plate structure 32 provided as part thereof is disposed across the vertical metal structure and spaced apart from, but capacitively coupled to the vertical metal structure 16. Metal plate structure 32 operates as a patch antenna element and contacts feed point 24 of feed circuit 19. In one embodiment, horizontal substrate 30 is provided from a dielectric material having a conductive material disposed on first and second opposing surfaces thereof. In one embodiment, the conductive material on the opposing surfaces of dielectric substrate are electrically coupled by one or more conductive via holes which extend through substrate to electrically couple the conductors disposed on the first and second opposing surfaces of substrate 30. The effective thickness of metal plate 32 is important and can be determined empirically (e.g. determined by iteration), but typically is thickened to improve antenna performance at the lower frequencies within the operational bandwidth of interest.

A top edge of vertical conductor 16 is spaced apart from horizontal conductor 30. The space between the top of vertical conductor 16 and horizontal conductor 30 may either be air-filled or filled with a dielectric material or a non-conductive adhesive material. The purpose of the spacing is so the patch is not shorted to the shaped metal tower. The patch characteristics are sensitive to this distance. Decreasing the distance will increase the capacitance. The distance is chosen as part of the design, which is iterated to find the optimal capacitance value for meeting performance requirements. In one embodiment, the spacing is accomplished using a dielectric spacer 33 having a thickness typically on the order of a few mils. In one exemplary embodiment, dielectric spacer 33 is provided as a dielectric material of the type manufactured by Rogers Corporation and identified as RO4350 having a thickness of about 0.01 inch and having a relative dielectric constant of about 3.66.

As noted above, patch element 32 may be formed on substrate 30 using additive or subtractive techniques as is generally known. For example conductors 32*a*, 32*b* may be provided on the substrate 30 by patterning copper patches 32*a*, 32*b* on opposing surfaces of substrate 30 and then providing one or more plated through holes generally denoted 35 through the conductors 32*a*, 32*b* to provide the effect of a thick metal conductor through substrate 30. Also, electrically coupled to patch element 32 are feed circuit elements 34 and 26 which feed patch 32 as described above.

Radiator 10 is responsive to RF signals within a frequency band of interest. through two different coupling mechanisms as follows. RF signals coupled or otherwise provided to the exposed end 17 (FIG. 1A) of coaxial line 18 are coupled into the unit cell 12. Coaxial feed line 18 and vertical conductor 16 guide current to feed point 24 which is coupled to a guided slotline mode which then radiates into free space. At lower frequencies within the band of interest, RF signals are coupled (i.e. either received by or emitted by) to the patch element 32. At higher frequencies within a band of interest, RF signals coupled into unit cell 12 through feed circuit 19 are emitted via a guided path slot mode within the unit cell structure 12. Thus, radiator 10 supports two radiation mechanisms; a first radiation mechanism due to the patch element and a second radiation mechanism via a guided path. The two radiation mechanisms are seamless (i.e. there is a seamless transition between those two different types of radiation which leads to a significant increase in operational bandwidth and scan of the radiator).

The above described feed circuit 19 may be used to couple an RF signal having a single linear polarization to/from radiator 10.

The exemplary radiator 8 in FIGS. 1-2, however, also includes a second feed circuit 19*a* comprised of a second coaxial feed line 16*a*, a second vertical conductor 18*a*, and a second feed point 24*a*. The second feed circuit 19*a* is arranged to excite RF signals on patch 32 and within unit cell 12 which are orthogonal to RF signals excited by feed circuit 19. In this way, the antenna element 10 is responsive to dual linear or circular polarizations.

As mentioned above, radome 11 is disposed within unit cell 12 over antenna element 10. Radome 11 is provided from a plurality of substrates 38 and 44. In this exemplary embodiment, radome 11 protects antenna element 10 (e.g. from exposure to environmental forces—e.g. wind, rain, etc...) and also performs an impedance matching function to match the antenna element impedance to free space impedance. Thus, in this exemplary embodiment, the physical and electrical characteristics of the components which make up both antenna element 10 and radome 11 are selected to cooperate in providing radiator 8 having a desired impedance match for RF signals received by and transmitted thereto.

Figure 2A:
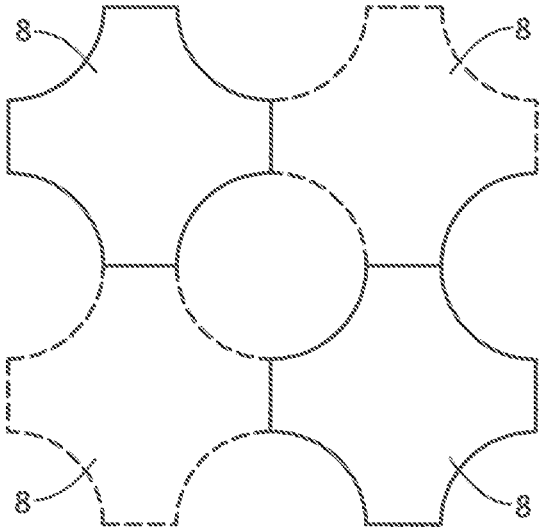
FIG. 2A is a top view of a plurality of unit cells of the dual polarization current loop radiator of FIG. 1.

In the exemplary embodiment of FIGS. 1-2, radome 11 includes a dielectric pixilated assembly 38 having a plurality of, here three (3), layers 40, 41 and 42. Although layers 40, 42 are here provided having some sides 9 having a radius, to provide layers having a particular shape, it should be appreciated that layers 40, 42 may also be provided having other shapes (e.g. square, rectangular, triangular, oval, or even irregular shapes). With layers 40, 42 having the exemplary geometric shape shown herein, when a plurality of radiators 8 comprised of layers 40, 42 having the same shape are arranged together, the radiators 8 provide the pattern shown in FIG. 2A.

Also, although three layers are shown, those of ordinary skill in the art will appreciate that pixilated assembly 38 may include fewer or greater than three layers The number of layers is a function of performance needs of bandwidth and scan requirements and allowable construction complexity. It could be any number from one layer to dozens of layers. More layers allows for more fine tuning of performance, but at the cost of increased sensitivity to tolerance and complexity of build. In many practical applications, a number of layers in the range of one to five (1-5) will result in an antenna having acceptable performance characteristics.

In one embodiment, pixilated assembly 38 is spaced from surface 32*a* of a substrate 32 by an air or foam layer 46 having a relative dielectric constant of about 1.0 having a thickness of about 0.05". Layer 40 of pixilated assembly 38 is provided from a dielectric having relative dielectric constant of about 6.15 and a thickness of about 0.05". In one particular embodiment, layer 40 may be provided from commercially available material such as RO4360 manufactured by Rogers Corporation. Layer 41 may be provided as air or from a foam substrate having a relative dielectric constant of about 1.0 and having a thickness of about 0.21". Layer 42 may be provided from a material having a relative dielectric constant of about 2.33 and a thickness of about 0.06". Layer 42 may be provided, for example, as Arion Clad233 having all copper removed.

Substrate 44 may be provided from a Ce/Quartz material having a relative dielectric constant of about 3.2 and having a thickness of about 0.015". A bottom surface 44*a* of a substrate 44 is spaced from a top surface 42*a* of a substrate 42 by a region 48 having a thickness of about 0.333". Region 48 may be air filled or may be provided from a foam material having a relative dielectric constant of about 1.0.

As mentioned above, the specific dimensions, dielectric constants and other characteristics mentioned above are exemplary only for operation in a frequency range of about 2.4 to 17.6 GHz. After reading the disclosure herein, those of ordinary skill in the art will understand how to adjust dimensions, dielectric constants and other characteristics of the structures described herein for operation within other frequency ranges.

Figure 3:
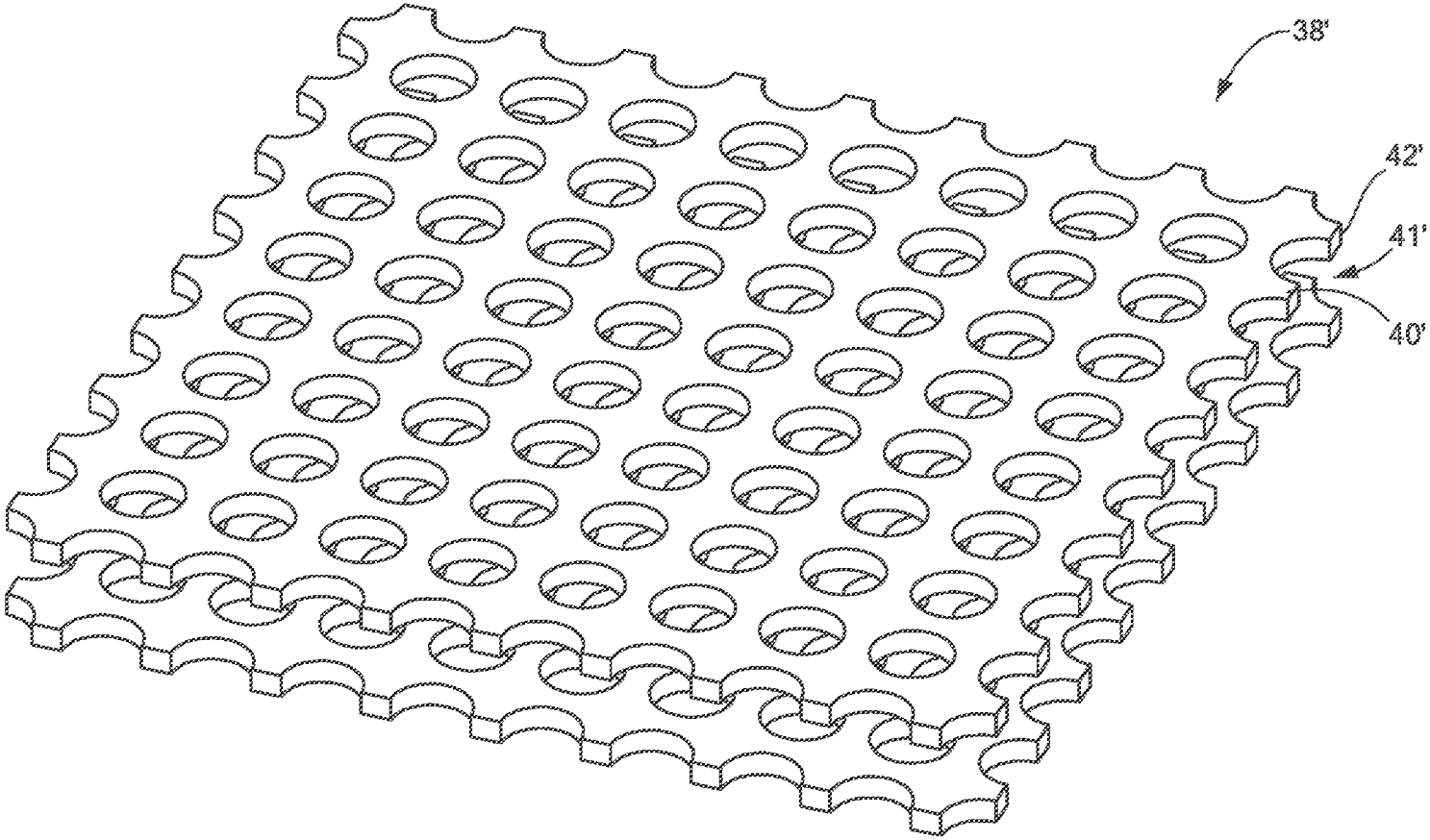
FIG. 3 is an isometric view of a dielectric pixelated assembly.
Figure 3A:
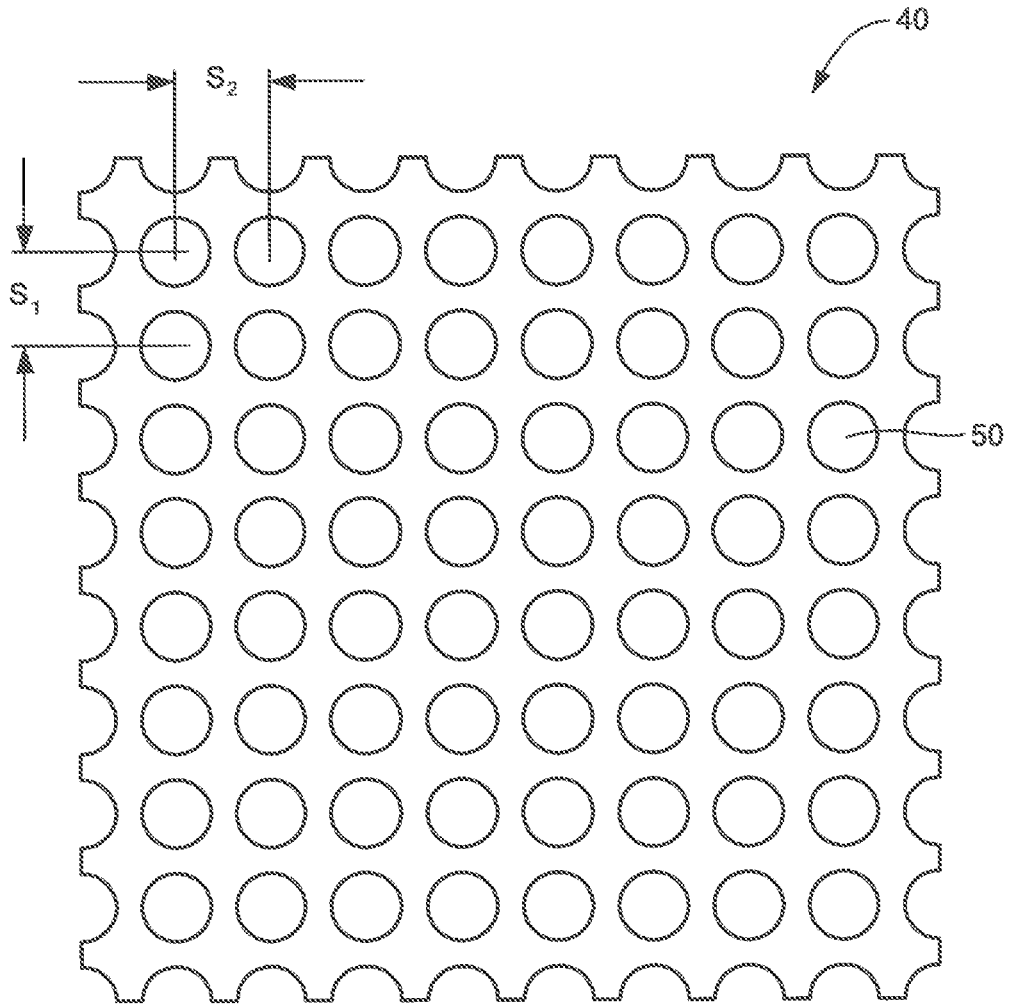
FIG. 3A is a top view of a first pixelated layer of the dielectric pixelated assembly of FIG. 3.
Figure 3B:
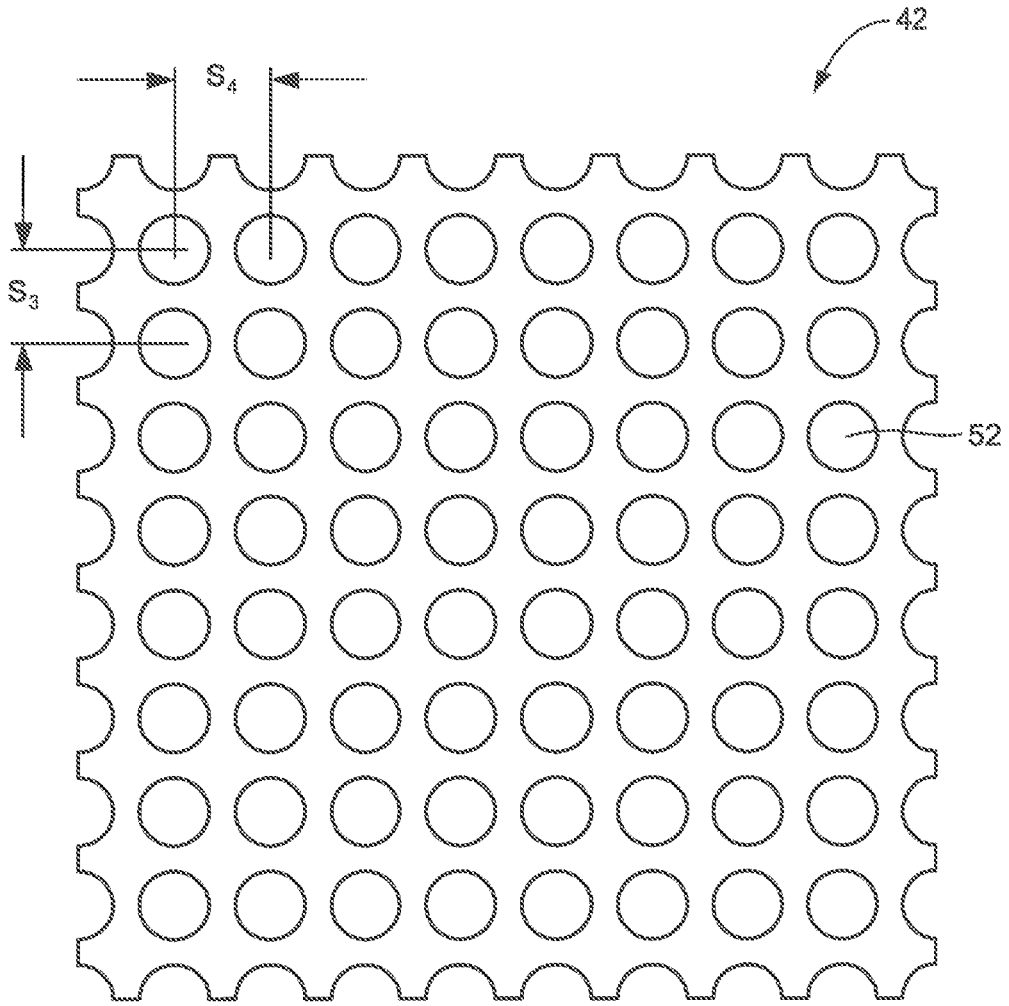
FIG. 3B is a top view of a second pixelated layer of the dielectric pixelated assembly of FIG. 3.

Referring now to FIGS. 3, 3A, 3B in which like elements are provided having like reference designations throughout the several views, an exemplary dielectric pixilated assembly 38' which may be the same as or similar to assembly 38 described above in conjunction with FIGS. 1-2, includes first layer 40', second layer 41' and a third layer 42'. Here second (or middle) layer 41' is an air layer. Layer 41' has a plurality of holes 50 provided therein with each hole having a diameter of about .232" with a center-to-center spacing of the holes being .32". Other hole spacings and hole patterns (e.g. a triangular lattice pattern) may of course also be used. It should be appreciated that the hole diameters and hole spacings are selected to optimize impedance match and scan performance. Certain scan performance is sensitive to dielectric modes. If the dielectric is removed in the region where these modes are active, then the performance is improved. Layers 40 and 42 (and layer 41, when not provided as air) need not have the same hole patterns, hole sizes, and geometric shapes and sizes, but doing so can result in efficiencies in cost, material and other resources in the manufacture of the radome.

It should also be appreciated that the holes sizes and patterns of each layer in assembly 38' need not be the same (i.e. each layer in assembly 38' may be provided having a unique hole pattern and unique holes sizes. Furthermore, the diameters of each hole on the same layer need not be the same. Different hole size are allowed both layer to layer and within the layer.

FIGS. 4-7 illustrate that a radiating element provided in accordance with the concepts described herein operates with two different radiation mechanisms to which results in a radiating element having a wide operational and that the transition between the two different radiation mechanisms within the operating frequency band is seamless.

Figure 4:
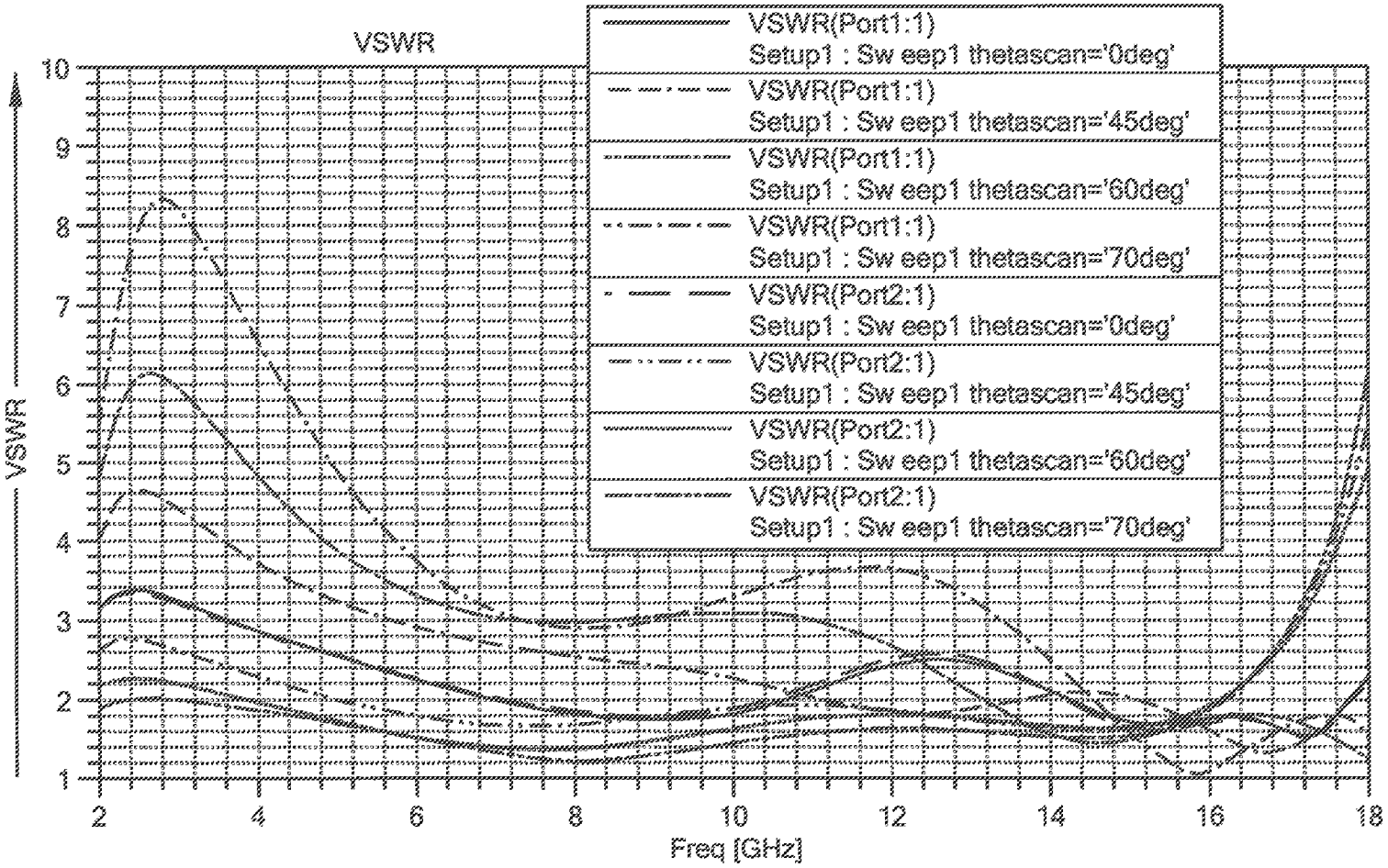
FIG. 4 is a plot of voltage standing wave ration (VSWR) of the antenna element vs. frequency.

Referring now to FIG. 4, a plot of voltage standing wave ration (VSWR) of the antenna element vs. frequency at a plurality of different scan angles ranging from 0 degrees to 70 degrees illustrates no "drop outs" over a wide range of frequencies.

Figure 5:
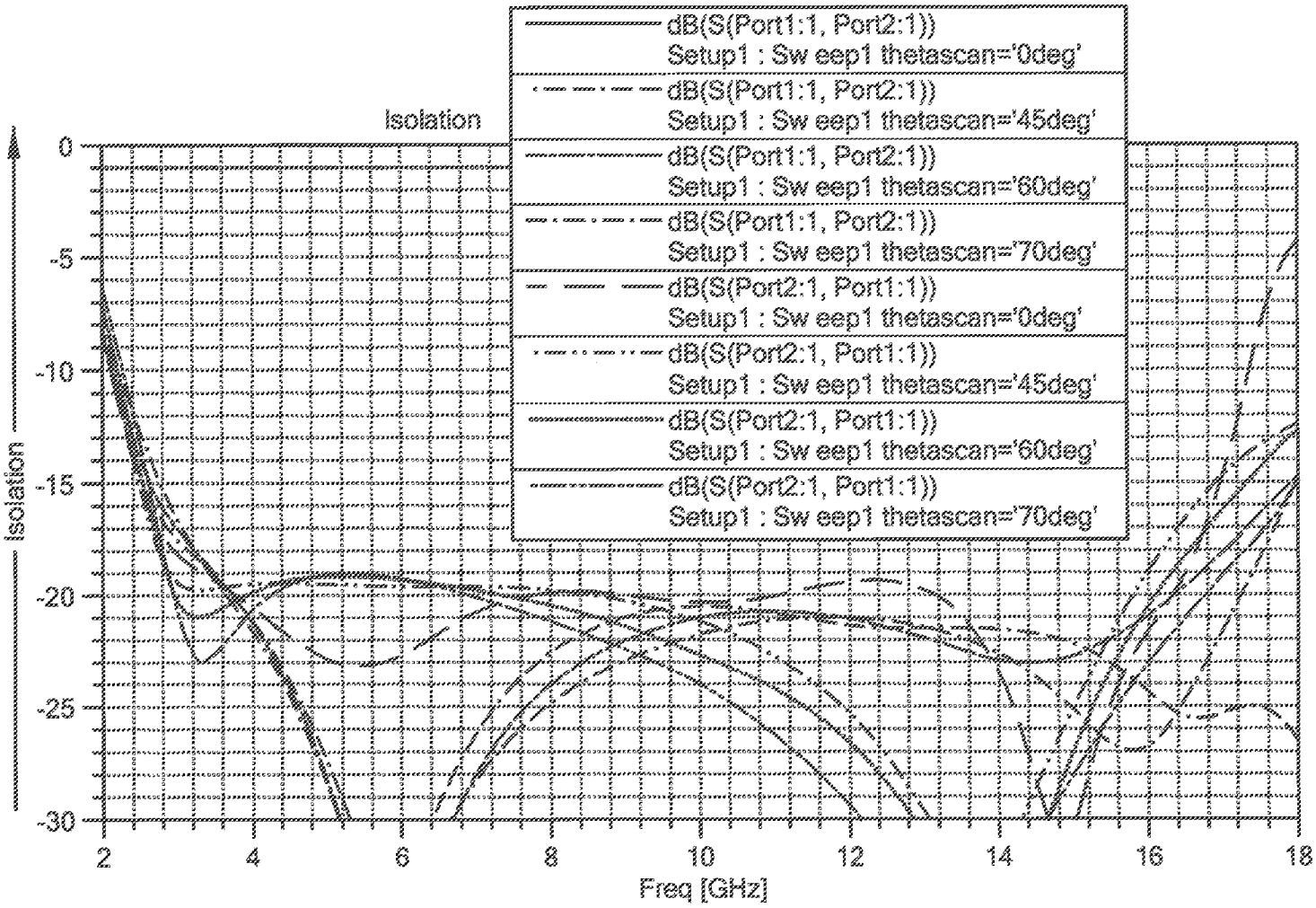
FIG. 5 is a plot of antenna isolation vs. frequency.

Referring now to FIG. 5, a plot of antenna isolation vs. frequency at a plurality of different scan angles ranging from 0 to 70 degrees illustrates no areas of poor isolation over a wide range of frequencies.

Figure 6:
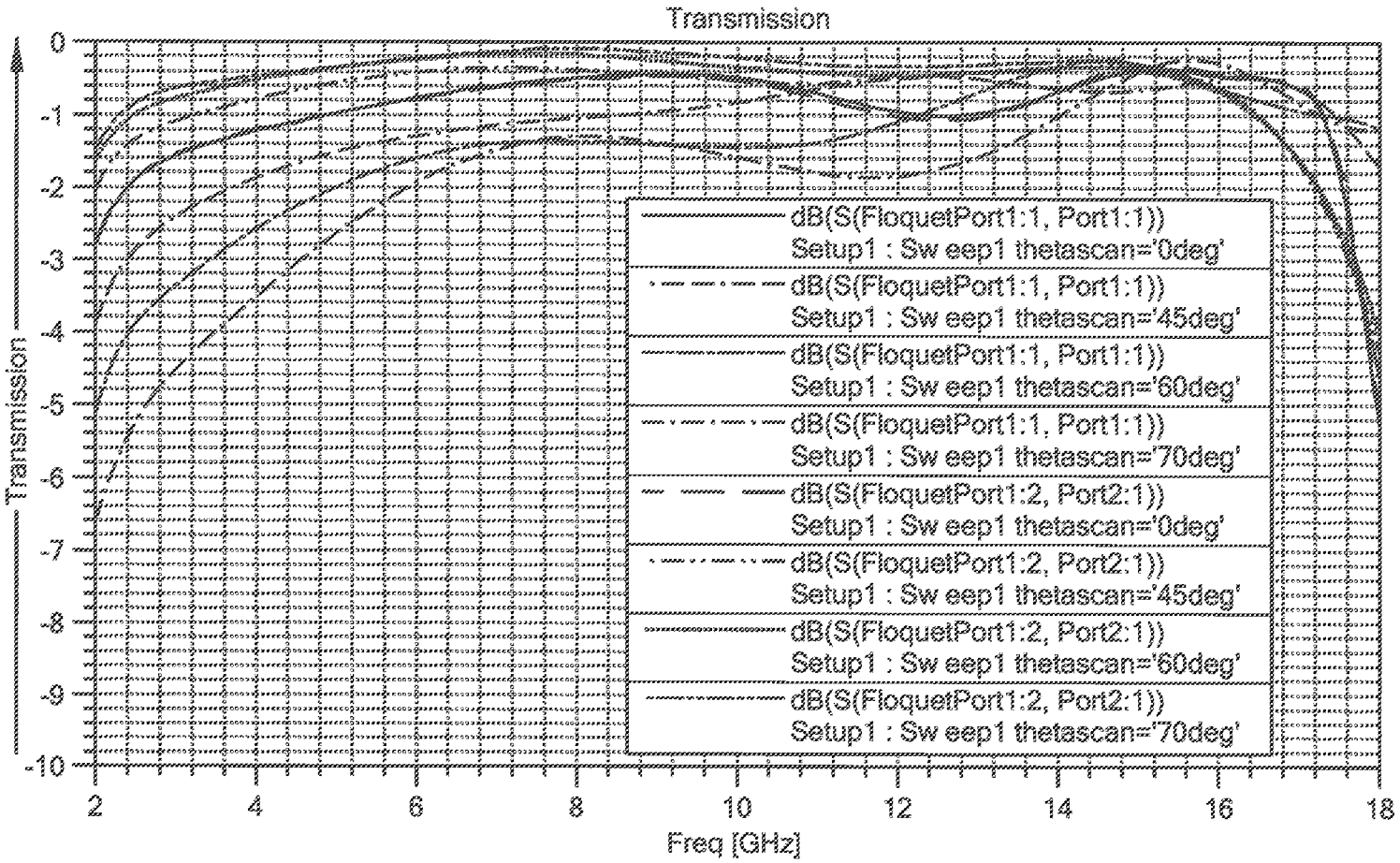
FIG. 6 is a plot of antenna transmission vs. frequency.

Referring now to FIG. 6, a plot of antenna transmission vs. frequency at a plurality of different scan angles ranging from 0 degrees to 70 degrees illustrates effective antenna transmission characteristics over a wide range of frequencies.

Figure 7:
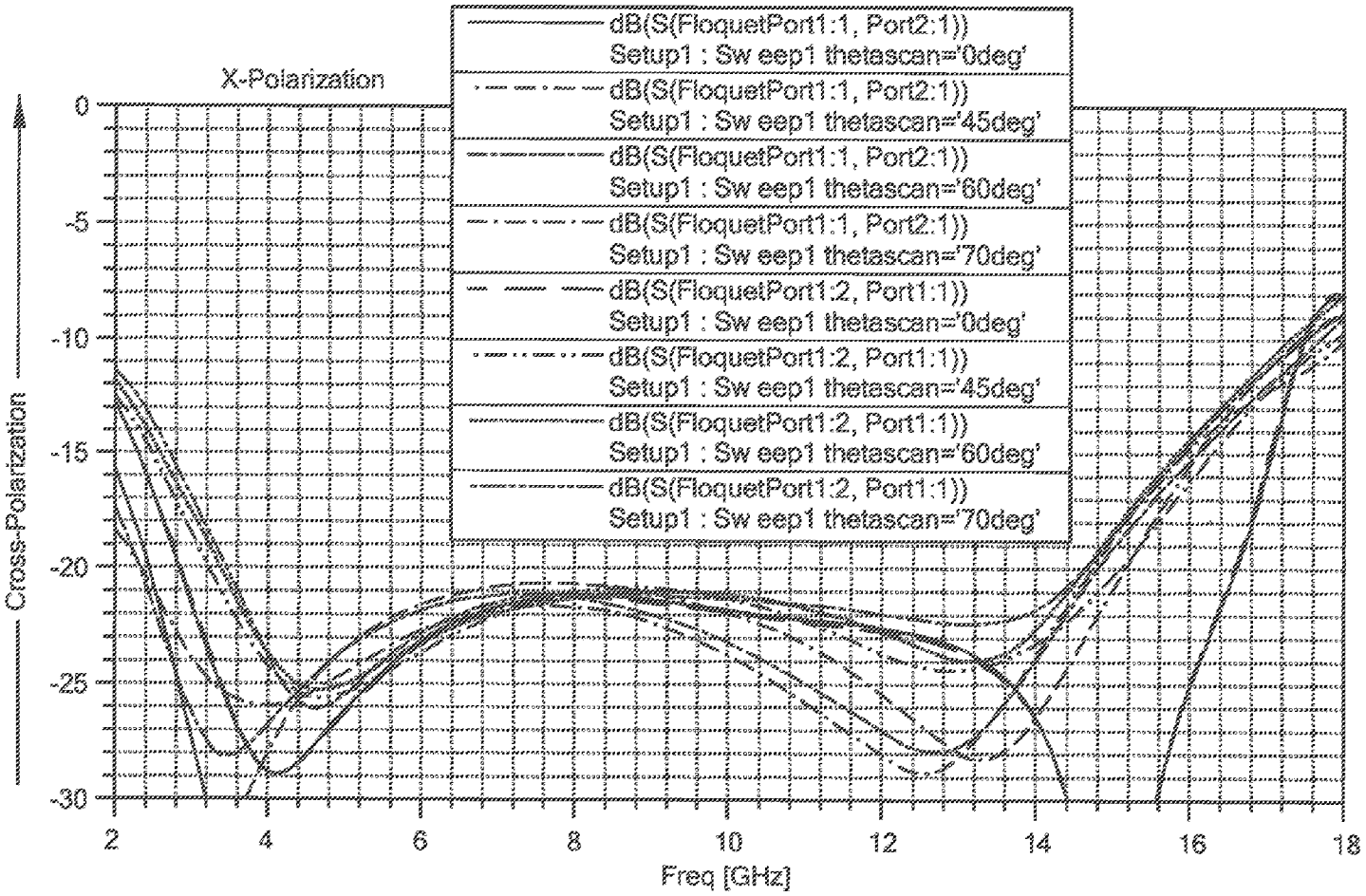
FIG. 7 is a plot of antenna cross polarization performance vs. frequency.

Referring now to FIG. 7, a plot of antenna cross polarization performance vs. frequency at a plurality of different scan angles ranging from 0 degrees to 70 degrees illustrates effective antenna cross polarization characteristics over a wide range of frequencies.

Figure 8:
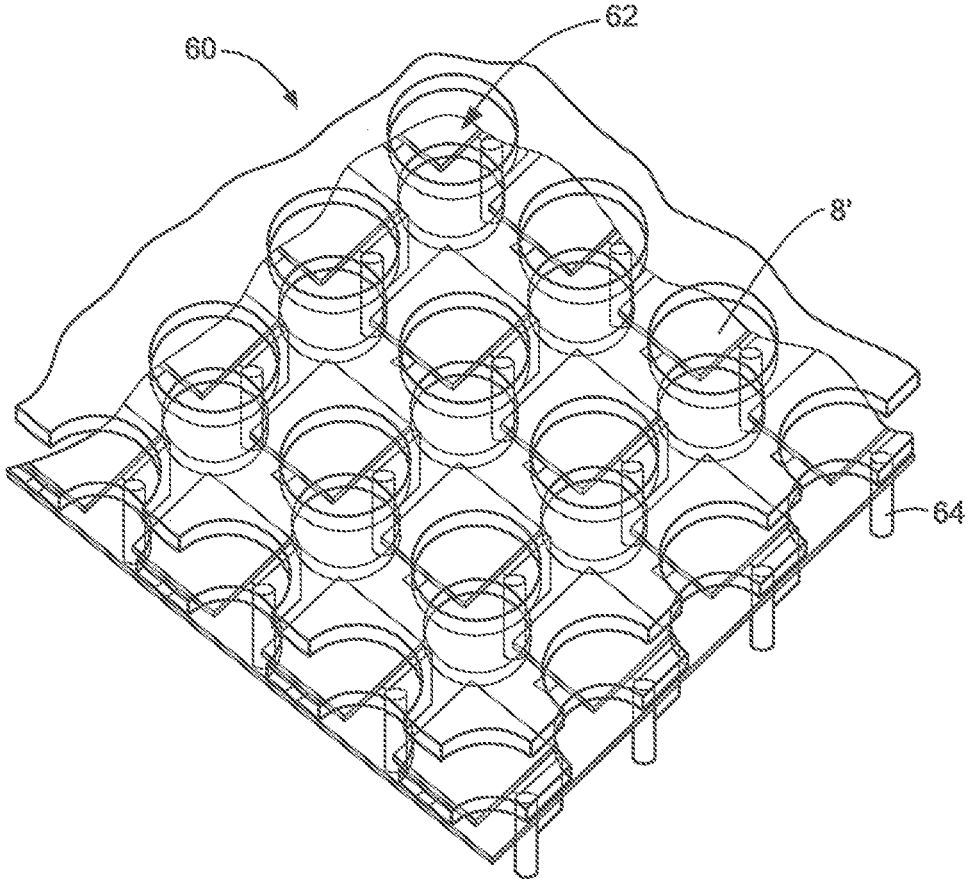
FIG. 8 is a perspective view of a phased array antenna comprised of a plurality of unit cells each of which comprises a dual polarization current loop radiator which my be the same as or similar to the dual polarization current loop radiator described above in conjunction with FIGS. 1-2.

Referring now to FIG. 8, a phased array antenna 60 is comprised of a plurality of unit cells 62. Each unit cell 62 is formed from and comprises a dual polarization current loop radiator 8' which may be the same as or similar to the dual polarization current loop radiator 8 described above in conjunction with FIGS. 1-2. Several feed lines 84 (which may be the same as or similar to coaxial feed lines 18, 18*a* described above in conjunction with FIGS. 1-2) are visible in FIG. 8. It should be noted that in the embodiment of FIG. 8, that at least some of the patch antenna elements are provided as conductors on a dielectric substrate and are fed by a feed circuit from an adjacent unit cell.

while particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

I claim:

1. An antenna element comprising: a radiator unit cell structure having a first open end and a second end with a conductive backplane disposed thereover, with the backplane corresponding to a ground plane; a first vertical conductor disposed in said radiating unit cell structure and electrically coupled to said backplane; a horizontal conductor disposed in said radiator unit cell structure and capacitively coupled to said first vertical conductor, said horizontal conductor corresponding to a patch antenna element; a first feed circuit electrically coupled to and disposed proximate and parallel to said first vertical conductor and having a first end electrically coupled to said backplane and having a second end electrically coupled to a first feed point proximate said horizontal conductor with said feed circuit positioned such that at a first frequency, said first feed circuit couples signals to said patch antenna element and at a second, higher frequency, said first feed circuit generates RF signals in a first guided path slotline mode formed by the first vertical conductor, at least one sidewall of the radiator unit cell structure and the first feed circuit within said radiator unit cell structure; a second vertical conductor, wherein the first vertical conductor and the second vertical conductor are electrically coupled together and to the backplane; and a second feed circuit electrically coupled to said second vertical conductor, wherein said second vertical conductor and said second feed circuit are disposed in said radiator unit cell structure to couple RF signals which are orthogonal to RF signals coupled to said first vertical conductor and said first feed circuit such that the antenna element is responsive to RF signals having dual linear polarizations; wherein said second feed circuit generates RF signals in a second guided path formed by the second vertical conductor and the second feed circuit and within said radiator unit cell structure, and wherein the first and second guided paths guide RF signals along sidewalls of the radiator unit cell structure to the first feed point and a second feed point respectively.

2. The antenna element of claim 1 wherein said patch antenna element is provided as a conductor on a dielectric substrate and said patch antenna element is fed by a third feed circuit from an adjacent unit cell.

3. The antenna element of claim 1 wherein said first feed circuit comprises a feed line provided as one of: a conductive via, a probe, or an exposed coaxial feed and wherein said first feed circuit uses part of said first vertical conductor to guide current to a patch antenna feed point of said patch antenna element that is capacitively coupled to said first vertical conductor.

4. The antenna element of claim 1 wherein a portion of said first vertical conductor is disposed on said ground plane.

5. A radiator comprising:

(a) a radome; and (b) an antenna element comprising:

a radiator unit cell structure having a first open end and a second end with a conductive backplane disposed thereover, with the backplane corresponding to a ground plane;

a first vertical conductor disposed in said radiator unit cell structure and electrically coupled to said backplane;

a horizontal conductor disposed in said unit cell structure and capacitively coupled to said first vertical conductor, said horizontal conductor corresponding to a patch antenna element;

a first feed circuit electrically coupled to and disposed proximate and parallel to said first vertical conductor and having a first end electrically coupled to said backplane and having a second end electrically coupled to a first feed point proximate said horizontal conductor, and with said first feed circuit positioned such that at a first frequency, said first feed circuit couples signals to said patch antenna element and at a second, higher frequency, said first feed circuit generates RF signals in a first guided path slotline mode formed by the first vertical conductor, at least one sidewall of the radiator unit cell structure and the first feed circuit within said radiator unit cell structure;

a second vertical conductor, wherein the first vertical conductor and the second vertical conductor are electrically coupled together and to the backplane;

and a second feed circuit electrically coupled to said second vertical conductor, wherein said second vertical conductor and said second feed circuit are disposed in said radiator unit cell structure to couple RF signals which are orthogonal to RF signals coupled to said first vertical conductor and said first feed circuit such that the antenna element is responsive to RF signals having dual linear polarizations;

wherein said second feed circuit generates RF signals in a second guided path formed by the second vertical conductor and the second feed circuit and within said radiator unit cell structure, and wherein the first and second guided paths guide RF signals along sidewalls of the radiator unit cell structure to the first feed point and a second feed point respectively.

6. The radiator of claim 5 wherein said radome comprises a dielectric pixilated assembly.

7. The radiator of claim 6 wherein said dielectric pixilated comprises three or more layers.

8. The radiator of claim 7 wherein at least one of said three or more layers corresponds to an air layer.

9. The antenna element of claim 5 wherein said patch antenna element is provided as a conductor on a dielectric substrate and said patch antenna element is fed by a third feed circuit from an adjacent unit cell.

10. The antenna element of claim 5 wherein said first feed circuit comprises a feed line provided as one of: a conductive via, a probe, or an exposed coaxial feed and wherein said first feed circuit uses part of said first vertical conductor to guide current to a patch antenna feed point of said patch antenna element that is capacitively coupled to said first vertical conductor.

11. The antenna element of claim 5 wherein a portion of said first vertical conductor is disposed on said ground plane.

12. A dual polarization current loop radiator comprising: a radiating unit cell structure having a closed end and an open end with the closed end corresponding to a ground plane; a first vertical conductor disposed in said radiating unit cell structure and electrically coupled to said ground plane; a second vertical conductor disposed in said radiating unit cell structure and electrically coupled to said ground plane and orthogonally disposed with respect to said first vertical conductor, wherein the first vertical conductor and the second vertical conductor are electrically coupled together and to a backplane; a patch antenna element disposed in said radiating unit cell structure and capacitively coupled to each of said first and second vertical conductors; a first feed circuit electrically coupled to and disposed proximate and parallel to said first vertical conductor and having a first end electrically coupled to said backplane and having a second end electrically coupled to a first feed point proximate said patch antenna element, and with said first feed circuit positioned such that at a first frequency, said first feed circuit couples RF signals to said patch antenna element and at a second, higher frequency, said first feed circuit generates RF signals in a first guided path slotline mode formed by the first vertical conductor, at least one sidewall of the radiator unit cell structure and the first feed circuit within said radiator unit cell structure; and a second feed circuit electrically coupled to said second vertical conductor and disposed proximate and parallel to said second vertical conductor and having a first end electrically coupled to said backplane and having a second end electrically coupled to a second feed point proximate said patch antenna element with said second feed circuit positioned such that at a first frequency, said second feed circuit couples RF signals to said patch antenna element and at a second, higher frequency, said second feed circuit generates RF signals in a second guided path formed by the second vertical conductor, at least one sidewall of the radiator unit cell structure and the second feed circuit within said radiator unit cell structure; and (b) a radome disposed over said antenna element with at least a portion of said radome disposed in said radiating unit cell structure such that at least a portion of said radome is integrated with said radiating element.

13. The dual polarization current loop radiator of claim 12 wherein each of said first and second feed circuits comprise respective ones of first and second feed lines and wherein said first and second feed lines are provided as one of: a conductive via, a probe, or an exposed coaxial feed using part of respective ones of first and second vertical conductors to form the first and second guided paths respectively and to guide current along sidewalls of the radiator unit cell structure to a respective one of the first and second feed points.

14. The dual polarization current loop radiator of claim 12 wherein said radome comprises a dielectric pixilated assembly.

15. The dual polarization current loop radiator of claim 14 wherein said dielectric pixilated assembly comprises three or more layers.

16. The dual polarization current loop radiator of claim 15 wherein at least one of said three or more layers corresponds to an air layer.

17. A phased array antenna comprising a plurality of unit cells with each of the unit cells comprising a dual polarization current loop radiator comprising: (a) an antenna element comprising: a radiator unit cell structure having a closed end and an open end with the closed end corresponding to a ground plane; a first vertical conductor disposed in said radiator unit cell structure and electrically coupled to said ground plane; a second vertical conductor disposed in said radiator unit cell structure and electrically coupled to said ground plane and orthogonally disposed with respect to said first vertical conductor, wherein the first vertical conductor and the second vertical conductor are electrically coupled together and to a backplane; a patch antenna element disposed in said radiator unit cell structure and capacitively coupled to each of said first and second vertical conductors; a first feed circuit electrically coupled to and disposed proximate and parallel to said first vertical conductor and having a first end electrically coupled to said backplane and having a second end electrically coupled to a first feed point proximate said patch antenna element with said first feed circuit positioned such that at a first frequency, said first feed circuit couples RF signals to said patch antenna element and at a second, higher frequency, said first feed circuit generates RF signals in a first guided path slotline mode formed by the first vertical conductor, at least one sidewall of the radiator unit cell structure and the first feed circuit within said radiator unit cell structure; and a second feed circuit electrically coupled to said second vertical conductor and disposed proximate and parallel to said second vertical conductor and having a first end electrically coupled to said backplane and having a second end electrically coupled to a second feed point proximate said patch antenna element with said second feed circuit positioned such that at a first frequency, said second feed circuit couples RF signals to said patch antenna element and at a second, higher frequency, said second feed circuit generates RF signals in a second guided path formed by the second vertical conductor, at least one sidewall of the radiator unit cell structure and the second feed circuit within said radiator unit cell structure; and (b) a radome disposed over said antenna element with at least a portion of said radome disposed in said radiator unit cell structure such that at least a portion of said radome is integrated with said antenna element.

18. The phased array antenna of claim 17 wherein said radome comprises a dielectric pixilated assembly.

19. The phased array antenna of claim 18 wherein said dielectric pixilated assembly comprises three or more layers.

20. The phased array antenna of claim 19 wherein at least one of said three or more layers corresponds to an air layer.

21. The antenna element of claim 1, wherein:

said first vertical conductor is oriented along a first vertical plane;

said horizontal conductor is disposed along a horizontal plane that is perpendicular to said first vertical plane, said horizontal conductor being spaced apart from and capacitively coupled to said first vertical conductor.

22. The antenna element of claim 21, wherein:

the second vertical conductor is oriented along a second vertical plane that is substantially parallel to the first vertical plane; and the second feed circuit electrically coupled to said second vertical conductor, wherein said second vertical conductor and said second feed circuit are disposed in said radiator unit cell structure to couple RF signals which are orthogonal to RF signals coupled to said first vertical conductor and said first feed circuit such that the antenna element is responsive to RF signals having dual linear polarizations.

* * * * *